US009522315B2

(12) United States Patent
Ruyssenaars et al.

(10) Patent No.: US 9,522,315 B2
(45) Date of Patent: Dec. 20, 2016

(54) SPORTS AND GAME PRODUCT

(71) Applicant: YOU.FO INTELLECTUAL PROPERTY HOLDING B.V., Amsterdam (NL)

(72) Inventors: Bas Boris Ruyssenaars, Amsterdam (NL); Sander Adrianus van Leeuwen, Den Haag (NL); Gosse Anne Jager, Sneek (NL); Stefanus Petrus Cornelis Maria Blonk, Breda (NL)

(73) Assignee: YOU.FO INTELLECTUAL PROPERTY HOLDING B.V., Amsterdam (NL)

( * ) Notice: Subject to any disclaimer, the term of this patent is extended or adjusted under 35 U.S.C. 154(b) by 110 days.

(21) Appl. No.: 14/424,552

(22) PCT Filed: Aug. 30, 2013

(86) PCT No.: PCT/NL2013/050630
§ 371 (c)(1),
(2) Date: Feb. 27, 2015

(87) PCT Pub. No.: WO2014/035248
PCT Pub. Date: Mar. 6, 2014

(65) Prior Publication Data

US 2015/0224378 A1 Aug. 13, 2015

(30) Foreign Application Priority Data

Aug. 30, 2012 (NL) ..... 2009389

(51) Int. Cl.

| | |
|---|---|
| ***A63B 65/12*** | (2006.01) |
| ***A63B 59/02*** | (2006.01) |
| ***A63B 67/06*** | (2006.01) |
| ***A63B 65/10*** | (2006.01) |
| ***A63B 65/00*** | (2006.01) |
| ***A63F 9/02*** | (2006.01) |

(52) U.S. Cl.
CPC ..... *A63B 67/06* (2013.01); *A63B 59/30* (2015.10); *A63B 60/34* (2015.10); *A63B 65/00* (2013.01);
(Continued)

(58) Field of Classification Search
CPC ..... A63B 59/02; A63B 59/08; A63B 65/10; A63F 9/02; F41B 3/04
(Continued)

(56) References Cited

U.S. PATENT DOCUMENTS 625,239 A * 5/1899 Beaudion ..... A63B 67/086 473/514
1,404,132 A * 1/1922 Manes ..... A63B 67/086 446/240
(Continued)

FOREIGN PATENT DOCUMENTS

DE 329699 C 12/1920

OTHER PUBLICATIONS

International Search Report and the Written Opinion, PCT/NL2013/050630, Oct. 1, 2013, 16 pages.
NL Search Report, NL2009389, Mar. 25, 2013, 13 pages.

*Primary Examiner* — Gene Kim
*Assistant Examiner* — M Chambers
(74) *Attorney, Agent, or Firm* — Edell, Shapiro & Finnan, LLC

(57) ABSTRACT

The present invention relates to a combination of at least one stick (10) and a ring device (30) configured for throwing and catching the ring device with the stick, wherein: —the stick comprises: —a main section (12) configured to be held by the hands of a user, a ring launching member (14) provided at one end (25) of the stick and configured to launch and catch the ring device, —the ring device comprises a central opening (72) and is constructed to fit on the ring launching
(Continued)

member and be launched from the ring launching. At take-off, the ring device is launched in a rotary manner.

12 Claims, 11 Drawing Sheets

(52) U.S. Cl.
CPC ..... *A63B 65/10* (2013.01); *A63F 9/02* (2013.01); *A63B 2060/0081* (2015.10)

(58) Field of Classification Search
USPC ..... 473/514, 505, 510, 512, 515
See application file for complete search history.

(56) References Cited

U.S. PATENT DOCUMENTS 1,905,932 A * 4/1933 Foster ..... A63B 59/30 124/31
2,009,252 A * 7/1935 Erickson ..... A63F 9/0208 124/5
2,085,610 A 6/1937 Schrickel
2,327,702 A * 8/1943 Flynt ..... A63F 9/02 124/37
2,371,567 A * 3/1945 Wilson ..... A63B 65/125 473/514
2,436,174 A * 2/1948 Myers ..... A63B 43/00 473/569
2,690,339 A * 9/1954 Hall ..... A63B 59/30 124/5
3,176,673 A * 4/1965 Dill ..... A63B 59/30 124/5
3,970,307 A * 7/1976 Breglia ..... A63B 59/30 124/5
4,673,186 A * 6/1987 Walker ..... A63B 59/20 273/399
5,421,584 A * 6/1995 Planinc ..... A63B 65/125 273/338
2015/0224378 A1 * 8/2015 Ruyssenaars ..... A63B 65/10 473/514

* cited by examiner $\alpha_1$
$\alpha_2$ 24
14
42
48
60
62

Fig. 13A
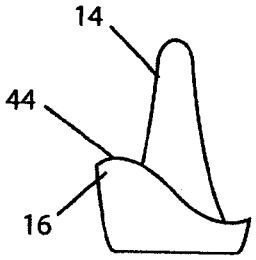
Fig. 13C
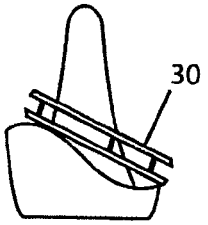
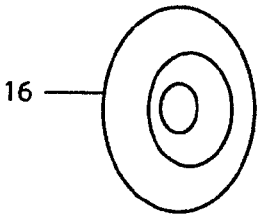
Fig. 13B
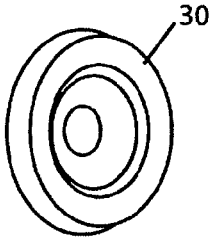
Fig. 13D 30
94
81
80
80
22
70B
70A
22
24
74
96
78

92
100
80
70A
201
84
82
81
94
85
86
78
22
200
79
90

30
77
81
76
72
79
F
F 100
80
70A
79
94
78
70B
80
100

70A
79
94
78
70B 70A
79
80
94
78
70B 70A
79
102
80
101
94
78
70B 70A
79
102
80
101
94
70B 70A
79
102
80
101
94
78
70B
102
101

80
94
70
79
78

80
82
94
70
79
78

79
80
84
94
82

14
32
10
38
30
10
32
14

48
α1
24
α3
28
16
32
26
10
α4
30
10
28
α4
α1
24
α3
22
32
26

F
F
26
30
24
14
110
10

24
14
G
16

32
22
110

SPORTS AND GAME PRODUCT

The present invention relates to a sports and game product, in particular to a combination of at least one stick and a ring device configured for throwing and catching the ring device with the stick.

PRIOR ART

Sticks and rings for throwing the sticks are known, for example from U.S. Pat. No. 2,127,433. It was found that improvements are possible and result in a more spectacular sports and game product.

THE INVENTION

The present invention relates to a combination of at least one stick and a ring device configured for throwing and catching the ring device with the stick, wherein:

the stick comprises:

- a main section configured to be held by the hands of a user,
- a ring launching member provided at one end of the stick and configured to launch and catch the ring device, the ring device comprises a central opening and is constructed to fit on the ring launching member and be launched from the ring launching member.

In an embodiment of the combination, the ring launching member has a cross-sectional area which is larger than the cross-sectional area of the main section.

In an embodiment of the combination, the cross-sectional area of the ring launching member increases from a tip of the ring launching member to a base of the ring launching member.

In an embodiment, the combination further comprises a stop which has a diameter which is greater than a diameter of a central opening of the ring device.

In an embodiment of the combination, the ring launching member defines an axis, i.e. a ring launching member axis, which is oriented at an angle $\alpha 1$ to an axis defined by the main section, i.e. a main section axis. The angle may be 90 to 170 degrees. In particular, the axis may extend at an obtuse angle, more in particular an angle $\alpha 1$ of 120-150 degrees to the axis 28 defined by the main section. The ring launching member axis is a main longitudinal axis of the ring launching member.

However, it is also possible to have a straight stick, i.e. a stick wherein the ring launching member axis and the main section axis are substantially aligned with one another.

In an embodiment of the combination, at least a part of the ring launching member has a substantially trumpet shape. The ring launching member may be connected to the main section via a short arm.

In an embodiment of the combination, in side view at least a part of the ring launching member has convex sides, concave sides, straight sides or a combination thereof, i.e. a concave left side and a convex right side, a straight left side and a concave right side, or a different combination.

In an embodiment of the combination, the stop member abuts a base of the ring launching member.

In an embodiment of the combination, the stop member and the base of the ring launching member are integral.

In an embodiment of the combination, the stop member defines a stop surface which is discontinuous with a surface of the ring launching member.

In an embodiment of the combination, the stop member defines an annular stop surface.

In an embodiment of the combination, at least a part of the ring launching member is asymmetric with respect to an axis defined by the ring launching member.

In an embodiment of the combination, the ring launching member defines an axis and is constructed to support the ring device in a launching position, wherein in the launching position a center of the ring device is offset with respect to the axis.

In an embodiment of the combination, the ring launching member comprises an eccentric ring support extension which is located substantially on an opposite side of the axis defined by the ring launching member as the angle $\alpha 1$ which is enclosed by the ring launching member axis and the main section axis.

The eccentric ring support extension is constructed to support the ring device in an eccentric position relative to the ring launching member axis. The eccentric position of the ring device may be a driving factor of the rotation of the ring device during the launch. This can be compared to the launch of a frisbee. In a frisbee, the user holds the frisbee eccentrically, i.e. at a distance from the center of gravity of the frisbee. When throwing the frisbee, the frisbee starts to rotate as a result of the eccentric force of the hand of the thrower.

The eccentric ring support extension cooperates with the ring launching member to work in a similar manner. When the combination of stick and ring device is positioned in a pre-launch orientation, the end of the stick with the ring is positioned somewhat to the rear of the user. In the pre-launch position, the ring device substantially hangs from the ring launching member. A lower part of the ring device is supported by the eccentric ring support extension. In this way, the ring device is relatively stable relative to the stick.

In the pre-launch position, the ring device engages the eccentric ring support extension in an eccentric manner. The ring device engages the ring launching member eccentric from its own centre of gravity, i.e. the centre of gravity of the ring device.

In the pre-launch position, a part of the inner edge of the ring device may not engage the ring launching member. In the pre-launch position, a space may be present between the surface of the ring launching member and the inner edge of the ring device. This space may be located on the outside of the stick, i.e. the side of the stick where the eccentric ring support extension is located and which faces away from the user.

During the launch, the force of the accelerating stick is transferred to the ring device in an eccentric manner, and not evenly over the entire circumference of the ring device. The force of the accelerating stick therefore is exerted on the ring device at a distance from the center of gravity of the ring device, like in a frisbee. This creates rotation of the ring device. It is noted that the ring device may generally rotate somewhat slower than a frisbee, but this is not a problem.

In an embodiment of the invention, the eccentric ring support extension is constructed to support the ring device in a pre-launch position in which the ring device axis extends at an angle to the ring launching member axis, i.e. is non-aligned with the ring launching member axis.

During the launch, the angle between the ring device axis and the ring launching member axis may decrease when the ring device comes loose from the eccentric ring support member and swirls around the ring launching member.

As a result, and in combination with the centrifugal force which is created by the swinging movement, during the launch the ring device may only contact the ring launching member at one side of the ring device and at one side of the ring launching member. At the opposite side of the ring launching member, the space exists between the ring device and the ring launching member. It is this one sided engagement which brings about the rotation, i.e. the swirl around the ring launching member.

In an embodiment, the eccentric ring support extension defines a ring support axis, and the ring support axis extends at an angle $\alpha 3$ of 90-120 degrees to the ring launching member axis, in particular 105-115 degrees.

In an embodiment, the ring support member axis extends at an angle $\alpha 4$ of 90-150 degrees to the main section axis, in particular at an angle of 100-140 degrees.

In an embodiment of the combination, the ring launching member has a first part and a second part, the first part having a rougher surface than the second part. The first part may be rougher than the surface of the ring device. It is also possible that the complete surface of the ring launching member is rough.

In an embodiment of the combination, the stick comprises a hand end and a ring end, wherein the stop member is located at a distance of between 10-30 percent of the length of the entire stick from the ring end. In particular, the stop member is located at a distance of 5-20 cm from the ring end of the stick In an embodiment of the combination, at least a part of the main section of the stick is curved. In particular the entire main section may be curved.

In an embodiment of the combination, the angle $\alpha 1$ between the ring launching member axis and a local orientation of the main section decreases when travelling along the main section in a direction away from the ring launching member.

In an embodiment of the combination, the ring launching member has a length of between 10 and 25 percent of the length of the stick.

In an embodiment of the combination, the main section has a length of between 60 and 90 percent of the length of the stick.

In an embodiment of the combination, the main section of the stick is configured to be held by two hands.

In another embodiment of the invention, the main section of the stick is configured to be held by one hand only. This embodiment is substantially shorter than the embodiment which is configured to be held by both hands. The one hand embodiment may have a hand grip which is configured to be held by a single hand.

In an embodiment of the combination, the stick has a total length of between 60-120 cm for the two-hand embodiment, and a total length 50-75 cm for the one hand embodiment.

Ring Device

In an embodiment of the combination, the ring device comprises two ring-shaped airfoils which are interconnected by one or more struts. In an embodiment of the combination, the ring device comprises three, four, five or six struts interconnecting the two ring-shaped airfoils.

In an embodiment of the combination, the two ring-shaped airfoils have similar or the same profiles which are in an inverted orientation with respect to one another.

In an embodiment of the combination, the central opening has a diameter of between 10 and 20 cm, in particular between 12 and 16 cm.

In an embodiment of the combination, the ring device defines an outer diameter of between 15 and 40 cm. in particular between 17 and 23 cm.

In an embodiment of the combination, the ring device comprises at least one ring-shaped airfoil having a separator lip extending along an outer perimeter of the airfoil, the separator lip being configured to force the airflow to become separate from the airfoil on at least one side of the airfoil.

In an embodiment of the combination, the diameter of the central opening is greater than the widest part of the ring launching member, but smaller than a diameter of the stop member.

In an embodiment of the combination, the sides of the ring-shaped airfoils which face away from one another comprise a convex part. The sides of the ring-shaped airfoils which face one another may be substantially flat. The sides of the ring-shaped airfoils which face one another may also comprise a convex part.

In an embodiment of the combination, the two ring-shaped airfoils are positioned at a distance from one another of between 1/10 and 1/3 of the inner diameter of the ring device.

In an embodiment of the combination, the two ring-shaped airfoils have a same inner diameter.

In an embodiment of the combination, the ring device is symmetrical about a plane which extends at an equal distance from both ring-shaped airfoils.

In an embodiment of the combination, the distance between the first and second ring shaped airfoils corresponds to a diameter of a tip of the ring launching member, allowing the tip to be inserted between the first and second airfoil.

In an embodiment of the combination, the ring device comprises a single ring-shaped airfoil. The ring-shaped airfoil may be symmetrical, i.e. have a same upper side and lower side. The single ring-shaped airfoil may also be non-symmetrical.

The present invention further relates to a stick configured for throwing and catching a ring device with the stick, wherein the stick comprises:

- a main section configured to be held by the hands of a user,
- a ring launching member provided at one end of the stick and configured to launch and catch the ring device, The present invention further relates to a ring device constructed to fit on a ring launching member of a stick according to the present invention and be launched from said ring launching member.

In an embodiment, both ring-shaped airfoils comprise a rigid annular part manufactured from a rigid material and a flexible annular part manufactured from a flexible material, wherein the rigid and flexible part are interconnected.

In an embodiment, the rigid material is in particular a thermoplastic material and the flexible material is an elastomeric material.

LIST OF FIGURES

The previous and other features and advantages of the present invention will be more fully understood from the following detailed description of exemplary embodiments with reference to the attached drawings.

FIGS. 13A-13D show more detailed side views of the embodiment of FIGS. 8A, 8B.

FIGS. 17A and 17B show a side view and top view of an open embodiment of the ring launching member.

DETAILED DESCRIPTION OF THE FIGURES

Figures 1A, 1B, 1C, 1D, 1E, 1F, 1G, 1H:
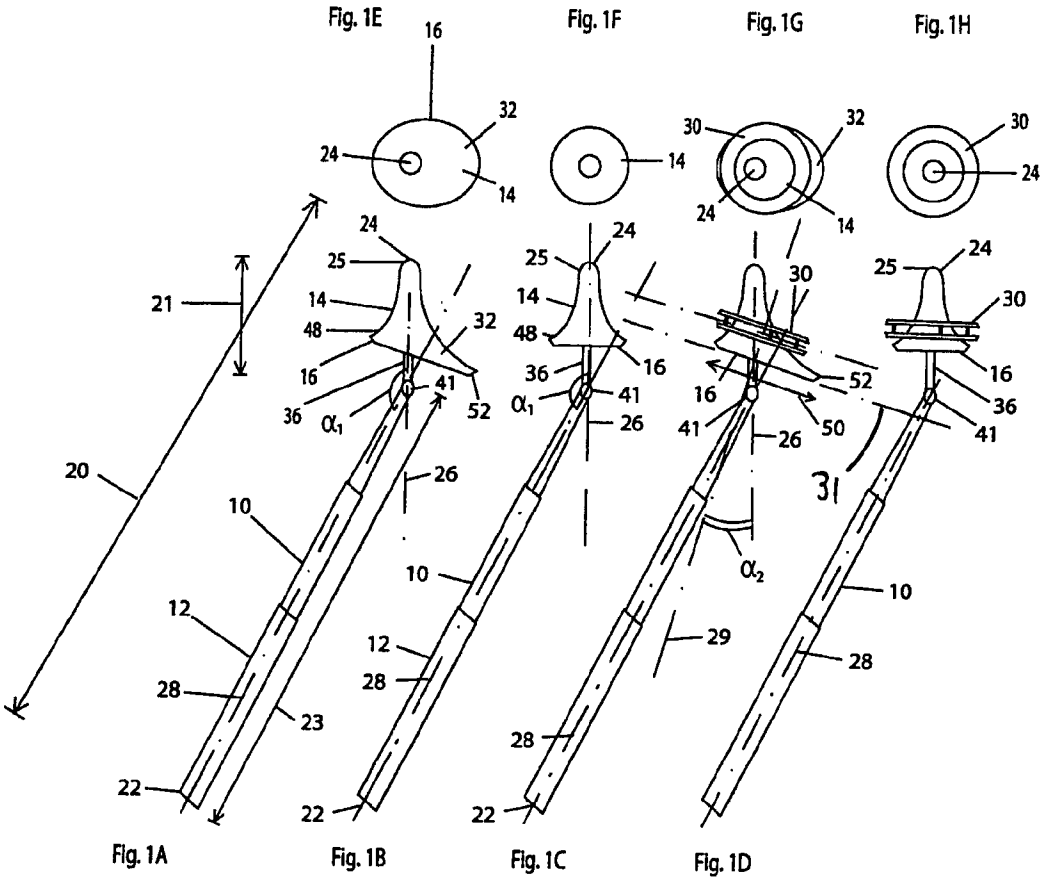
FIG. 1A shows a side view of a first embodiment of a stick according to the invention.
FIG. 1B shows a side view of a second embodiment of a stick according to the invention.
FIG. 1C shows a side view of the stick of FIG. 1A with a ring device.
FIG. 1D shows a side view of the stick of FIG. 1B with a ring device.
FIG. 1E shows a top view of the ring launching member of the stick of FIG. 1A.
FIG. 1F shows a top view of the ring launching member of the stick of FIG. 1B.
FIG. 1G shows a top view of the ring launching member of the stick of FIG. 1C with a ring device.
FIG. 1H shows a top view of the ring launching member of the stick of FIG. 1D with a ring device.

Turning to FIGS. 1A, 1C, 1E and 1G, a first embodiment of the invention is shown. A stick 10 comprises a main section 12 and a ring launching member 14. The main section 12 and the ring launching member 14 are connected to one another at 41, which is a bend. The ring launching member 14 comprises a stop 16. The stick 10 has a length 20, a proximal end 22, also called hand end 22, and a distal end 25, also indicated as launching end 25 or ring end 25. The main section 12 is elongate and long enough to be gripped by both hands of the user. In this embodiment, the main section 12 is straight or substantially straight.

The ring launching member 14 is constructed to accommodate a ring device 30, shown in FIG. 1C. The ring launching member has a base 48 and a tip at 24. The tip 24 of the ring launching member may be rounded, but may also be flat. The ring launching member 14 defines a first axis 26, also indicated as ring launching member axis 26. The axis 26 is a main longitudinal axis of the ring launching member. The axis 26 extends from the tip 24 of the ring launching member 14 to the bend 41 where the ring launching member 14 is connected to the main section. The ring launching member 14 has a length 21 when taken along the axis 26.

A cross-sectional area of the ring launching member, taken in a plane perpendicular to the ring launching member axis 26, is greater than the cross-sectional area of the main section. In other words, the ring launching member 14 is thicker than the main section. The cross-sectional area of the ring launching member 14 decreases from the base 48 to the tip 24. The cross-sectional area has a maximum at the base 48 and a minimum at the tip 24. The ring launching member 14 may have a substantial trumpet shape, or a cone shape.

In this embodiment, the stop member 16 is formed by the rim 52 of the ring launching member 14. The stop 16 has a diameter 50 which is greater than a diameter of a central opening of the ring device 30. In this way, the ring device can not pass the stop 16 and reach the hands of the user.

The ring launching member 14 is not mounted on the main section directly, but via a relatively short arm 36. The arm 36 is considered part of the ring launching member. The short arm 36 may be fully covered by the ring launching member 14, and be invisible for this reason.

It is shown in FIGS. 1A, 1C, 1E and 1G that the ring launching member 14 is asymmetrical. The ring launching member comprises a ring support extension 32 at one side of the ring launching member axis 26. It is the ring support extension which provides the asymmetrical shape of the ring launching member. The part of the ring launching member 14 above the ring support extension 32 may also be asymmetrical.

The ring device 30 defines a ring axis 29 which may extend at an angle $\alpha 2$ relative to the ring launching member axis 26. The angle $\alpha 2$ may be 0-30 degrees, in particular 15-25 degrees.

The main section 12 defines a second axis 28, i.e. a main section axis 28. The main section 12 has a length 23 when taken along the axis 28. The ring launching member axis 26 and the main section axis 28 meet one another at the bend 41 and extend at an angle $\alpha 1$ to one another. The angle $\alpha 1$ which is made by the bend 41 is obtuse and may lie between 90 and 170 degrees, more preferably between 120 and 150 degrees.

In another embodiment, the stick is straight and the ring launching member axis 26 and the main section axis 28 are substantially aligned with one another. In this embodiment, there is no bend 41, or only a very slight bend.

The ring support extension 32 is located at an opposite side of the ring launching member axis 26 as the angle $\alpha 1$ which is enclosed by the ring launching member axis 26 and the main section axis 28. In other words, in FIG. 1A the angle $\alpha 1$ is located on the left side of the ring launching member 14 and the ring support extension 32 is located on the opposite side, i.e. the right side, of the ring launching member 14.

FIG. 1G shows that the ring device 30 rests on the ring launching member 14 in an orientation which is substantially parallel to the stop member 16. In other words, the stop member 16 defines a plane which is parallel to a plane defined by the ring device when the ring device is in a resting position.

Turning to FIGS. 1B, 1D, 1F, 1H, a second embodiment is shown. This embodiment is substantially similar to the embodiment of FIGS. 1A, 1C, 1E and 1G, but has a symmetrical ring launching member 14, i.e. without the ring support extension 32. In this embodiment, the ring device 30 may rest on the ring launching member 14 in an orientation in which the ring axis 29 is parallel or substantially parallel to the ring launching member axis 26.

Figure 2D:
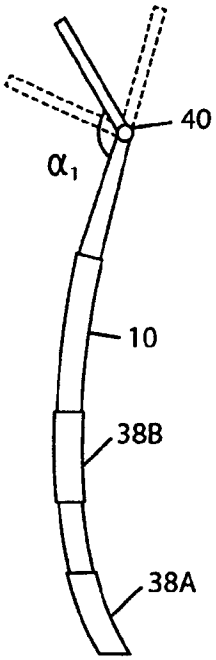
FIG. 2D shows a side view of a fourth embodiment of a stick without the ring launching member.
Figure 2C:
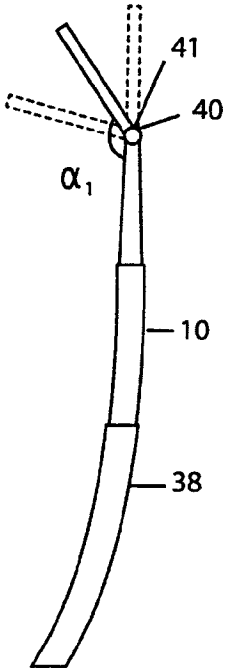
FIG. 2C shows a side view of a third embodiment of a stick without the ring launching member.
Figure 2B:
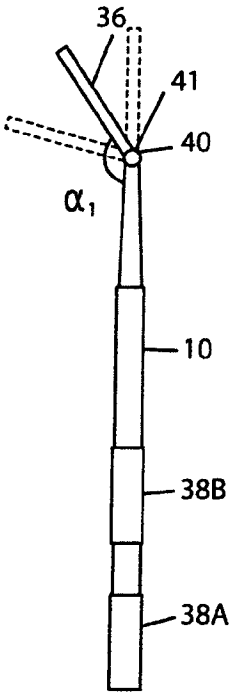
FIG. 2B shows a side view of a second embodiment of a stick without the ring launching member.
Figure 2A:
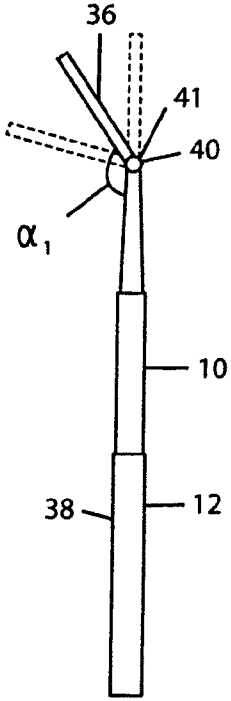
FIG. 2A shows a side view of a first embodiment of a stick without the ring launching member.

Turning to FIG. 2A, the stick 10 may comprise a hand grip covering 38, for instance rubber, leather, or a different kind of covering which provides a good grip for the hands of the user. A hinge 40 may be provided to allow the user to vary the angle $\alpha 1$. The stick 10 may be manufactured from a hard plastic, wood, or metal, or from a combination of materials. The main section may comprise one or more visual signs indicating correct hand positions.

FIG. 2B shows another embodiment which has two separate covered sections, one section 38A for the left hand and one section 38B for the right hand (or vice versa for left handers), with an interspacing 39 without any covering.

FIG. 2C shows an embodiment in which the end of the main section 12 is curved. FIG. 2D shows another variant in which the main section 12 is slightly curved and wherein two separate covered hand grips 38A, 38B are provided.

Figure 2E:
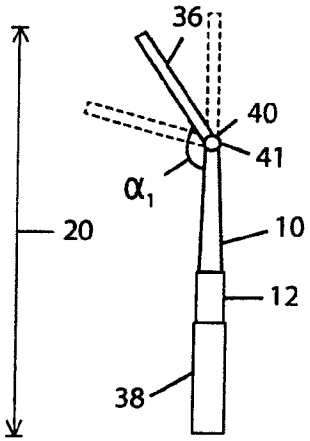
FIG. 2E shows a side view of a fourth embodiment of a stick without the ring launching member.

FIG. 2E shows an embodiment which is configured for one hand. The main section 12 is shorter than the main section of the embodiments of FIGS. 2A, 2B, 2C and 2D. The covered section 38 is long enough to be gripped by one hand, but too short to be gripped by two hands. The length 20 of the stick 10 this embodiment is 50-75 cm. The ring launching member can be one of the ring launching members disclosed herein for a two handed stick.

Figures 3A, 3B, 3C, 3D, 4A, 4B, 4C, 4D, 5A, 5B, 5C, 5D, 6A, 6B, 6C, 6D:
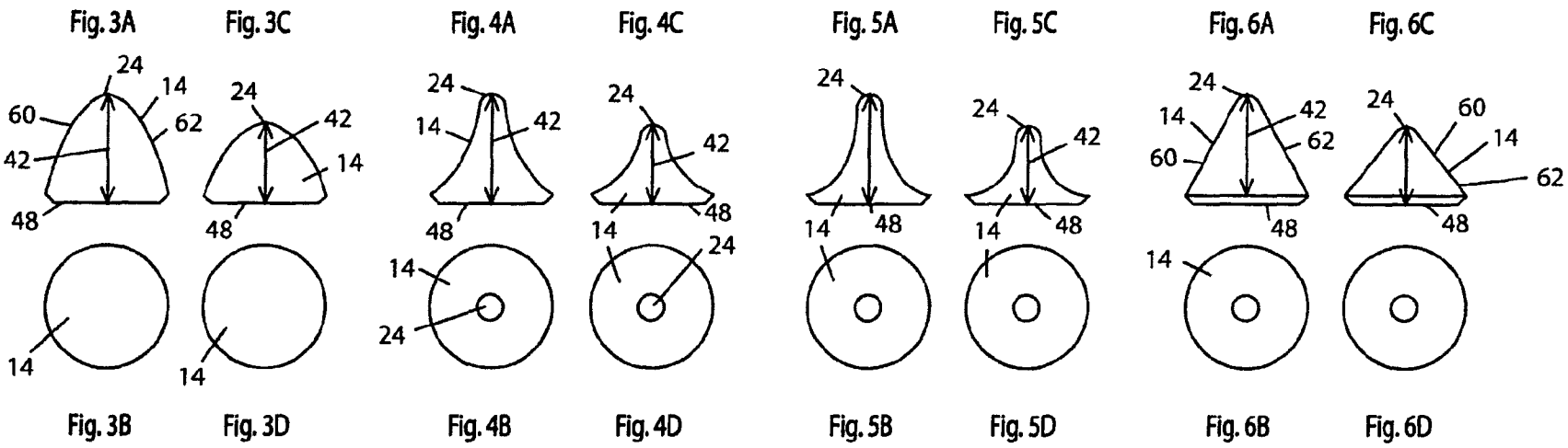
FIGS. 3A, 3C, 4A, 4C, 5A, 5C, 6A, 6C, 7A, 7C, 8A, 9A, 9C, 10A, 10B, 10C and 17A show side views of different embodiments of the ring launching member.
FIGS. 3B, 3D, 4B, 4D, 5B, 5D, 6B, 6D, 7B, 7D, 8B, 9B, 9D and 17B show top views of different embodiments of the ring launching member.

Turning to FIGS. 3A, 3B a ring launching member 14 having a cone shape with a convex cross section is shown. The longitudinal cross-section is taken parallel to the axis 26 defined by the ring launching member 14. Both the left side 60 as the right side 62 of the cross-section are convex. FIGS. 3C, 3D show a similar ring launching member 14 having a cone shape with a convex cross section, but a reduced height 42. The main section 12 is not shown, but it will be clear that the main section is present in order to form a complete stick.

Turning to FIGS. 4A, 4B a ring launching member 14 having a trumpet shape with a concave cross section is shown. The cross-sectional area of the ring launching member increases gradually and at an increasing rate when travelling from the tip 24 to the base 48. Both the left side 60 and the right side 62 are concave. FIGS. 4C, 4D show a similar ring launching member 14 having a trumpet shape with a concave cross section, but a reduced height 42.

Turning to FIGS. 5A, 5B a ring launching member 14 having a trumpet shape with a concave cross section is shown, but the concavity is stronger than in FIGS. 4A and 4C. The cross-sectional area of the ring launching member increases at an increasing rate when travelling from the tip 24 to the base 48. FIGS. 5C, 5D show a similar ring launching member 14 having a trumpet shape with a stronger concave cross section, but a reduced height 42.

Turning to FIGS. 6A, 6B a ring launching member 14 having a substantially cone shape, i.e. with a straight sides 60, 62 is shown. The cross-sectional area of the ring launching member increases at a steady rate when travelling from the tip 24 to the base 48. The tip 24 itself is rounded. The tip 24 may also be flat or substantially flat, which results in a substantially frusto-conical form. FIGS. 6C, 6D show a similar ring launching member 14 having a cone shape with straight sides, but a reduced height 42.

Figures 7A, 7B, 7C, 7D, 8A, 8B, 9A, 9B, 9C, 9D, 10A, 10B, 10C, 17A, 17B:
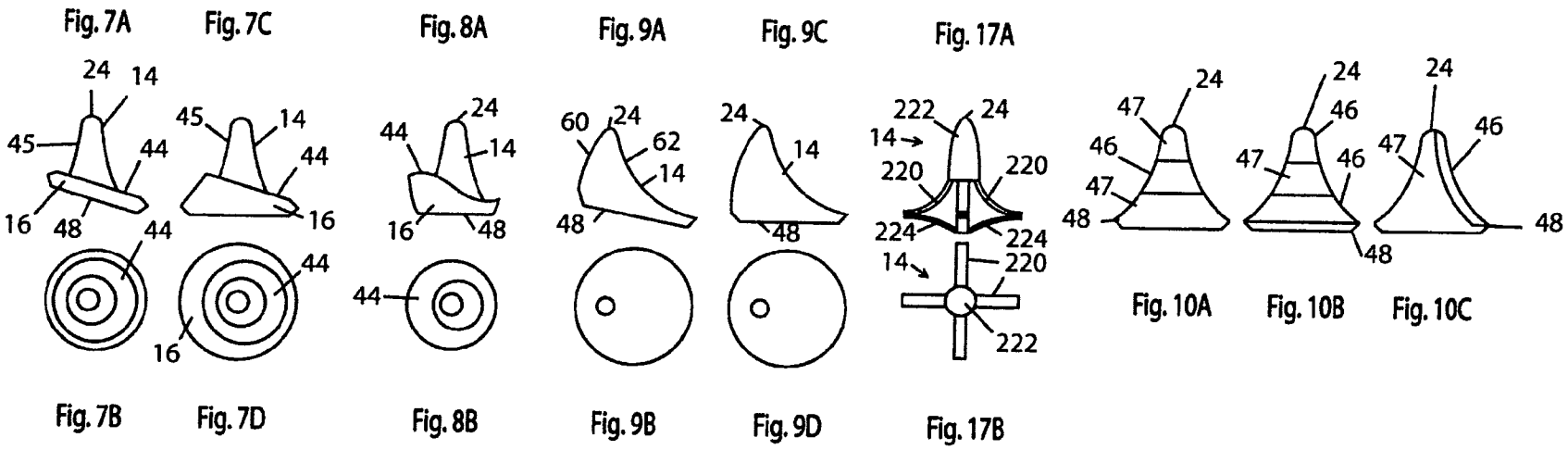

Turning to FIGS. 7A and 7B, an embodiment is shown in which the stop member 16 is discontinuous with the rest of the ring launching member 14, i.e. in which the cross-section of the ring launching member 14 increases abruptly at the stop 16. A flat, annular ring support surface 44 is formed on which in use, the ring device 30 rests. The ring support surface 44 is discontinuous with a surface of the rest of the ring launching member 14. It is visible in FIG. 7B that the ring support surface 44 is offset with respect to the tip 24 of the ring launching member.

FIGS. 7C and 7D show an embodiment which is similar to FIG. 7A, 7B but in which the stop member 16 has a tapered form, when seen in side view. In these embodiments, the cone has a concave cross-section.

Turning to FIGS. 8A and 8B, an embodiment is shown in which the annular surface 44 is curved, when seen in side view.

FIGS. 9A and 9B show another embodiment in which a cross-section of the ring launching member 14 has one side 60 which is convex and another side 62 which is concave. The ring launching member is asymmetric. It is also possible that the ring launching member 14 has a shape which is partly straight and partly concave, i.e. straight near the tip 24 and concave near the base 48.

Generally, the ring launching member 14 has a cross section of which the area increases from the tip 24 to the base 48.

Turning to FIGS. 17A, 17B an embodiment of the ring launching member 14 is shown which is partially open. Curved beams 220 extend downwardly and outwardly from a connecting member 222 at the top. The connecting member 222 may have the form of a cone. Reinforcing beams 224 may also be provided at the base 48. The stop member 16 is formed by the four outer ends of the curved beams 220. A different number than four beams 220 is possible.

Turning to FIGS. 10A, 10B, 10C further embodiments of the ring launching member are shown, which comprise one or more roughened sections 46. The rough sections 46 may have a roughness which may be similar to the roughness of rubber, sandpaper or a rough carpet. The rough section(s) are located adjacent one or more smooth sections 47.

In FIG. 10A, the roughened section is located as an annulus extending around the circumference of the ring launching member 14 at about halfway the distance between the base 48 and the tip 24. In FIG. 10B, two roughened sections are located respectively at the tip 24 and at the base of the ring launching member 14. In FIG. 10C, one or more roughened sections 46 are provided as bands extending from a base of the ring launching member to the tip of the ring launching member located respectively at the tip 24 and at the base 48 of the ring launching member 14.

FIGS. 11A-11D show the same embodiment of the ring launching member 14 as FIGS. 7A, 7B, but in more detail and with a ring device 30. The ring device 30 is urged in an orientation in which the ring axis 29 makes an angle $\alpha 2$ of about 15-30 degrees with an axis 26 defined by the ring launching member 14. The annular surface 44 therefore also makes an angle $\alpha 2$ of about 15-30 degrees with the ring launching member axis 26. A center 73 of the central opening 72 of the ring device is offset with respect to the ring launching member axis over a distance 75.

Figures 11A, 11B, 11C, 11D, 12A, 12B, 12C, 12D:
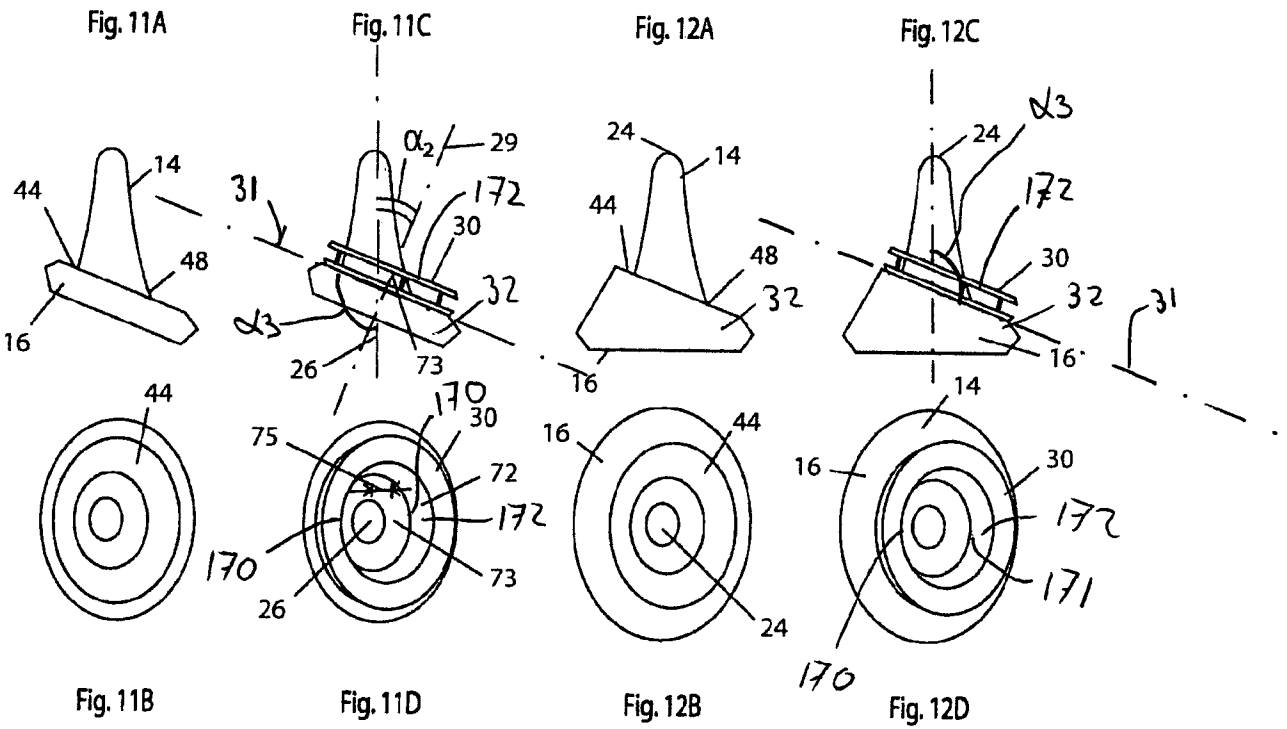
FIGS. 11A-11D show more detailed side views of the embodiment of FIGS. 7A, 7B.
FIGS. 12A-12D show more detailed side views of the embodiment of FIGS. 7C, 7D.
Figures 14A, 14B, 14C:
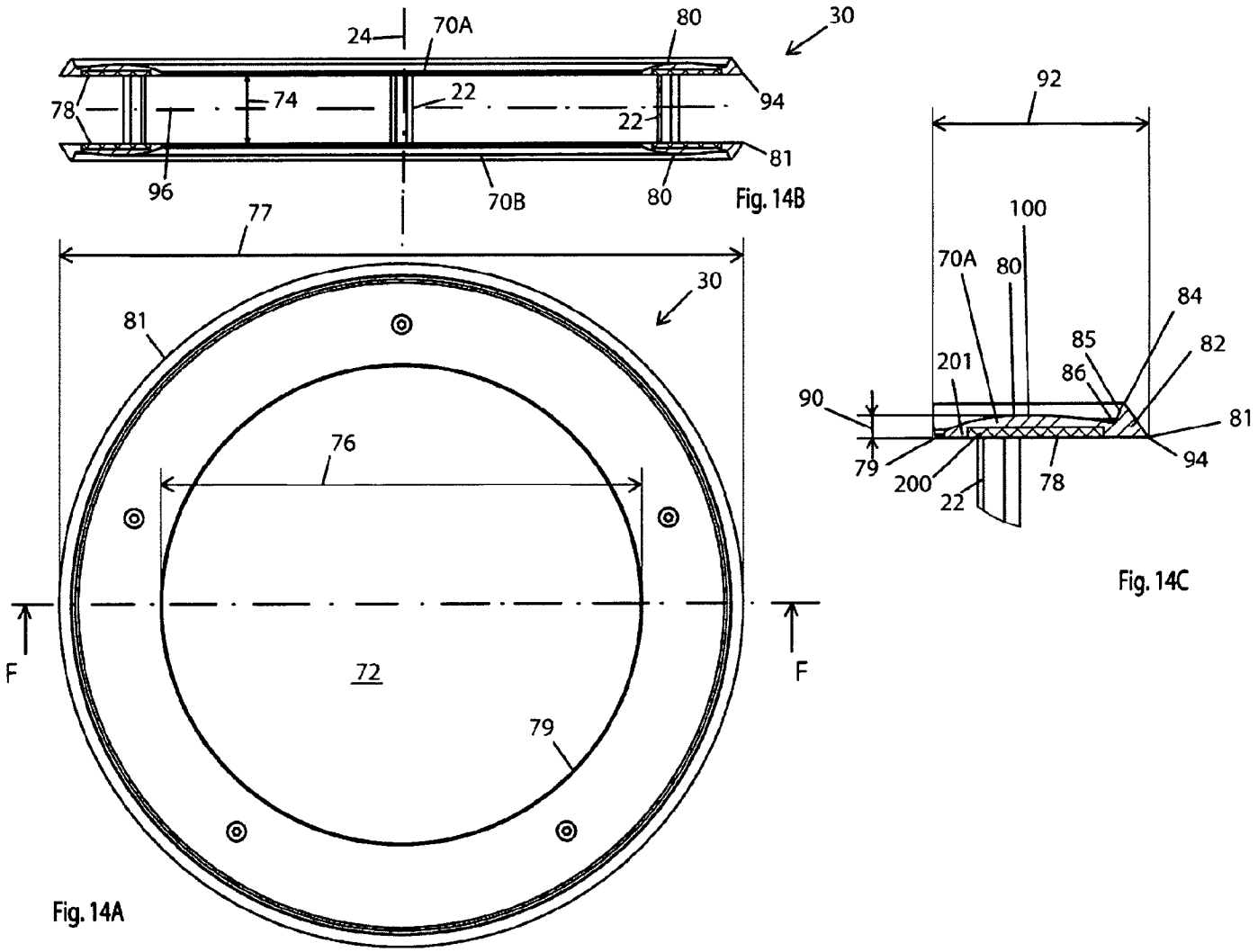
FIG. 14A shows a top view of the ring device.
FIG. 14B shows a sectional view of the ring device along the lines F-F in FIG. 14A.
FIG. 14C shows a sectional view of a part of a ring-shaped airfoil.
Figure 14D:
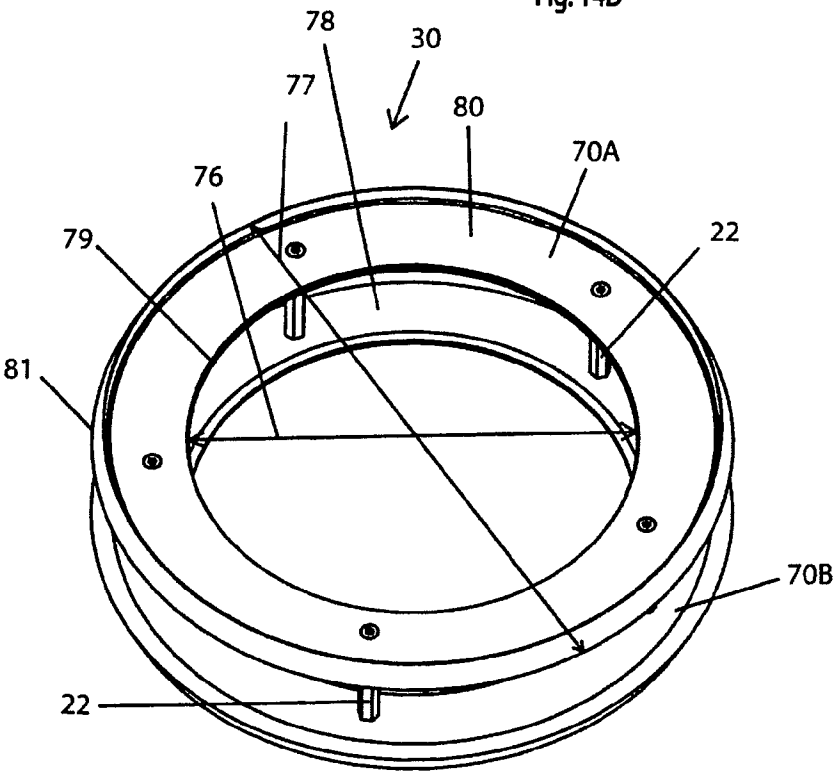
FIG. 14D shows an orthogonal sectional view of the ring device.

As shown in FIGS. 11D and 12D, the ring device 30 contacts the ring launching member on one side 170. Here, the inner perimeter 79 of the ring device contacts the ring launching member. At the opposite side 171, a space 172 exists between the ring device and the ring launching member. The eccentric position, i.e. the combination of contact on one side 170 and a space 172 on the other side 171 causes a rotation during the launch. The swinging movement of the launch causes the ring device to start rotating, similar to a frisbee.

FIGS. 12A-120 show the same embodiment of the ring launching member 14 as FIGS. 7A, 7B, but in more detail and with a ring device 30. The stop 16 is asymmetrical, and is tapered when seen in side view. The ring support surface 44 is flat.

FIGS. 13A-13D show the same embodiment of the ring launching member 14 as FIGS. 8A, 8B, but in more detail and with a ring device 30. It is shown that the ring device 30 contact the annular surface 44 at a relatively high position and at a low position.

Turning to FIGS. 14A, 14B, 14C and 14D, the ring device 30 is shown. The ring device comprises two airfoils 70A, 70B interconnected by struts 22. The struts 22 have a length 74 and maintain the two airfoils at a distance 74 from one another. The ring device has a central opening 72 defined by an inner perimeter 79 of the airfoils 70*a*, 70B. The central opening 72 has a diameter 76.

The two airfoils 70A, 70B have a similar size, i.e. a similar inner diameter 76 and a similar outer diameter 77. The ratio between the distance 74 between the airfoils and the inner diameter 76 is between 1:6 and 1:9, preferably 1:7. The sides 78 of the airfoils which face one another are substantially flat. The sides 80 of the airfoils which face away from one another are convex. A separator lip 82 is provided along the outer perimeter 81 of the airfoils 70A, 70B. The separator lip has a forward side 83 leading up to sharp peak 84 which is higher than the immediately adjacent portion of said upper surface, and a rear side 85 which descends sharply to a transition point 86 with the convex side 80 of the airfoil 70.

The ratio between the inner diameter 76 and the outer diameter 77 is about 7:10, i.e. lies between 6:10 and 8:10.

The airfoil has a maximum thickness at an apex 100 which lies at about 60 percent of the chord length 92, i.e. between 50 and 70 percent of the chord length 92, when measured from the leading edge 94. The ring device 30 is symmetrical about plane 96 which extends parallel to the airfoils 70A, 70B at equal distance from both airfoils.

The outer diameter 77 is typically 200 mm, i.e. between 170 mm and 230 mm, but other dimensions between 150 mm and 400 mm are possible. The inner diameter 76 is typically 140 mm, i.e. between 100 mm and 180 mm. The chord length 92 is typically 30 mm, i.e. between 20 and 40 mm. The distance 74 is typically 20 mm, i.e. between 17 and 23 mm.

The struts 22 may have a hexagonal cross section. It was found that this form has a good aerodynamic behaviour. The struts may also have a circular or other cross section. The mass of the ring device may be between 50 and 250 gram, typically between 60 and 100 gram. Each ring shaped airfoil comprises a first part 200 manufactured from a rigid material and a second part 201 manufactured from a flexible material. The part 200 may be manufactured from hard plastic.

Figures 15A, 15B, 15C, 15D, 15E, 15F, 15G, 15H, 15I:
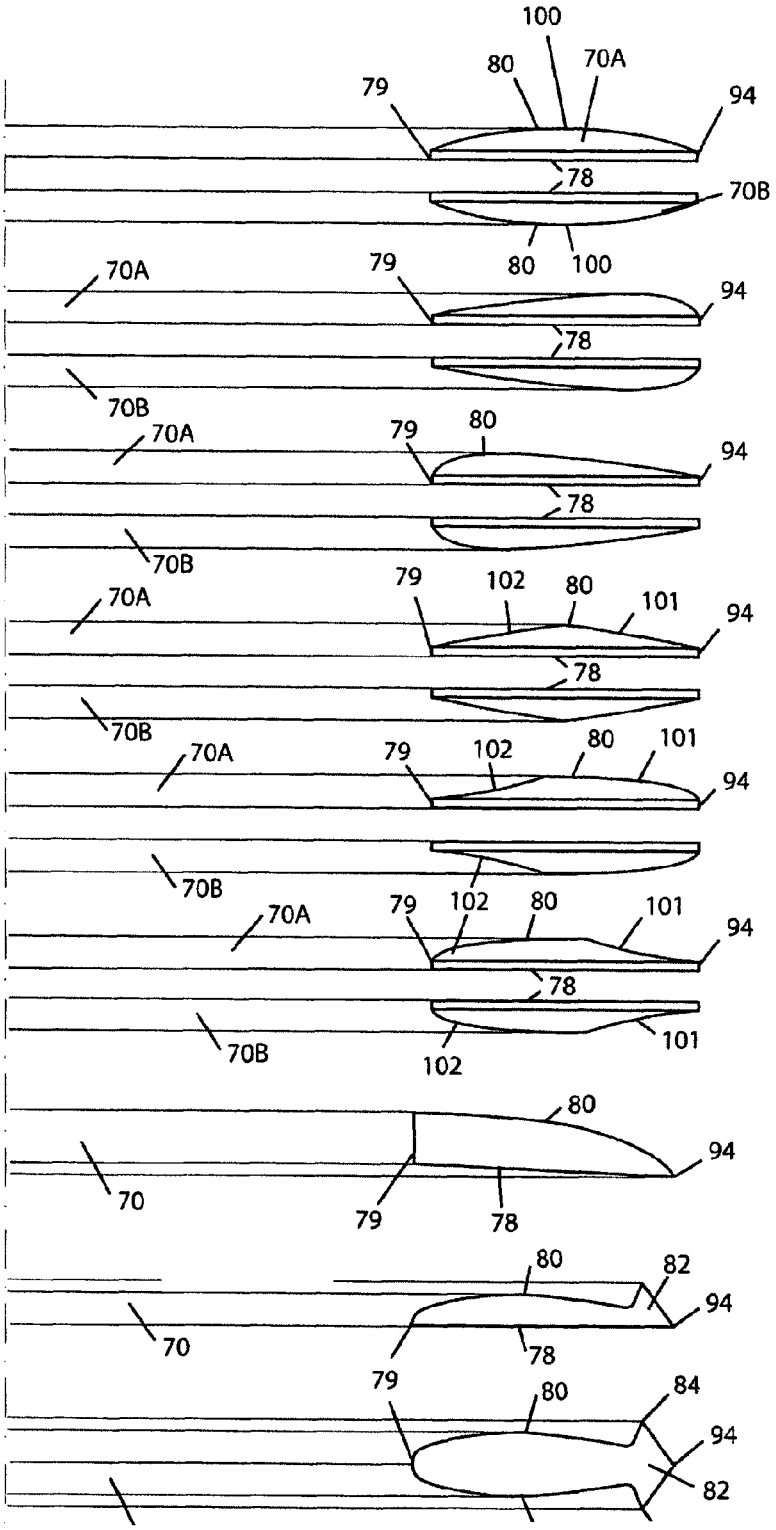
FIGS. 15A, 15B, 15C, 15D, 15E and 15F show partial cross sections of further embodiments of the airfoils of the ring device.
FIGS. 15G, 15H, 15I show partial cross sections of an embodiment of the ring device having a single airfoil.

Turning to FIGS. 15A-15F, further airfoils 70*a*, 70B for the ring device are shown. In FIG. 15A, the airfoils have a convex outer side 80 wherein the apex 100 of the convex sides of the airfoils is located substantially half way the chord, i.e. between 40 and 60 percent of the chord length. No separator lip is provided along the outer perimeter, but a separator lip may be provided in another embodiment.

FIG. 15B shows an embodiment in which the airfoils 70A, 70B have a convex outer side 80 and a flat inner side 78, and wherein the apex 100, i.e. the thickest portion of the airfoils lies at about 25 percent of the chord length from the outer perimeter 81, i.e. between 20 and 30 percent of the chord length from the outer perimeter 81.

FIG. 15C shows an embodiment in which the airfoils 70A, 70B have a convex outer side 80 and a flat inner side 78, and wherein the apex 100, i.e. the thickest portion of the airfoils lies at about 75 percent of the chord length from the inner perimeter 79, i.e. between 70 and 80 percent of the chord length from the outer perimeter 81.

FIG. 15D shows an embodiment in which the airfoils 70A, 70B have an outer side 80 which comprises two substantially flat sections 101, 102 and a flat inner side 78, and wherein the apex 100, i.e. the thickest portion of the airfoils lies at about 50 percent of the chord length from the outer perimeter 81, i.e. between 40 and 60 percent of the chord length.

FIG. 15E shows an embodiment in which the airfoils 70A, 70B have an outer side 80 which comprises an outer, convex section 101 and an inner, concave section 102, and wherein the apex 100, i.e. the thickest portion of the airfoils lies at about 60 percent of the chord length from the outer perimeter 81, i.e. between 50 and 70 percent of the chord length from the outer perimeter 81.

FIG. 15F shows an embodiment in which the airfoils 70A, 70B have an outer side 80 which comprises an outer, concave section 101 and an inner, convex section 102, and wherein the apex 100, i.e. the thickest portion of the airfoils lies at about 40 percent of the chord length from the outer perimeter 79 i.e. between 30 and 50 percent of the chord length.

The distance 74 between the airfoils 70A, 70B is about 16 percent of the chord length 92.

FIG. 15G shows an embodiment of the ring device having a single airfoil 70. The airfoil 70 is asymmetric and has a convex upper side 80 and a straight lower side 78.

FIG. 15H shows another embodiment of the ring device having a single airfoil 70. The airfoil has a convex upper side 80 and a flat lower side 78. The airfoil has a separator lip 82 which extends upwards.

FIG. 15I shows an embodiment having a single airfoil 70. The airfoil has a convex upper side 80 and a convex lower side 78. The embodiment of FIG. 15I is a combination of two airfoils of FIG. 15H connected to one another with the flat sides 78. The airfoil has a separator lip 82 which extends both upwards and downwards.

The airfoils of FIGS. 15G,15H,15I are relatively thick, have a substantial height 90 relative to the chord 92.

Figures 18A, 18B, 18C, 18D, 18E:
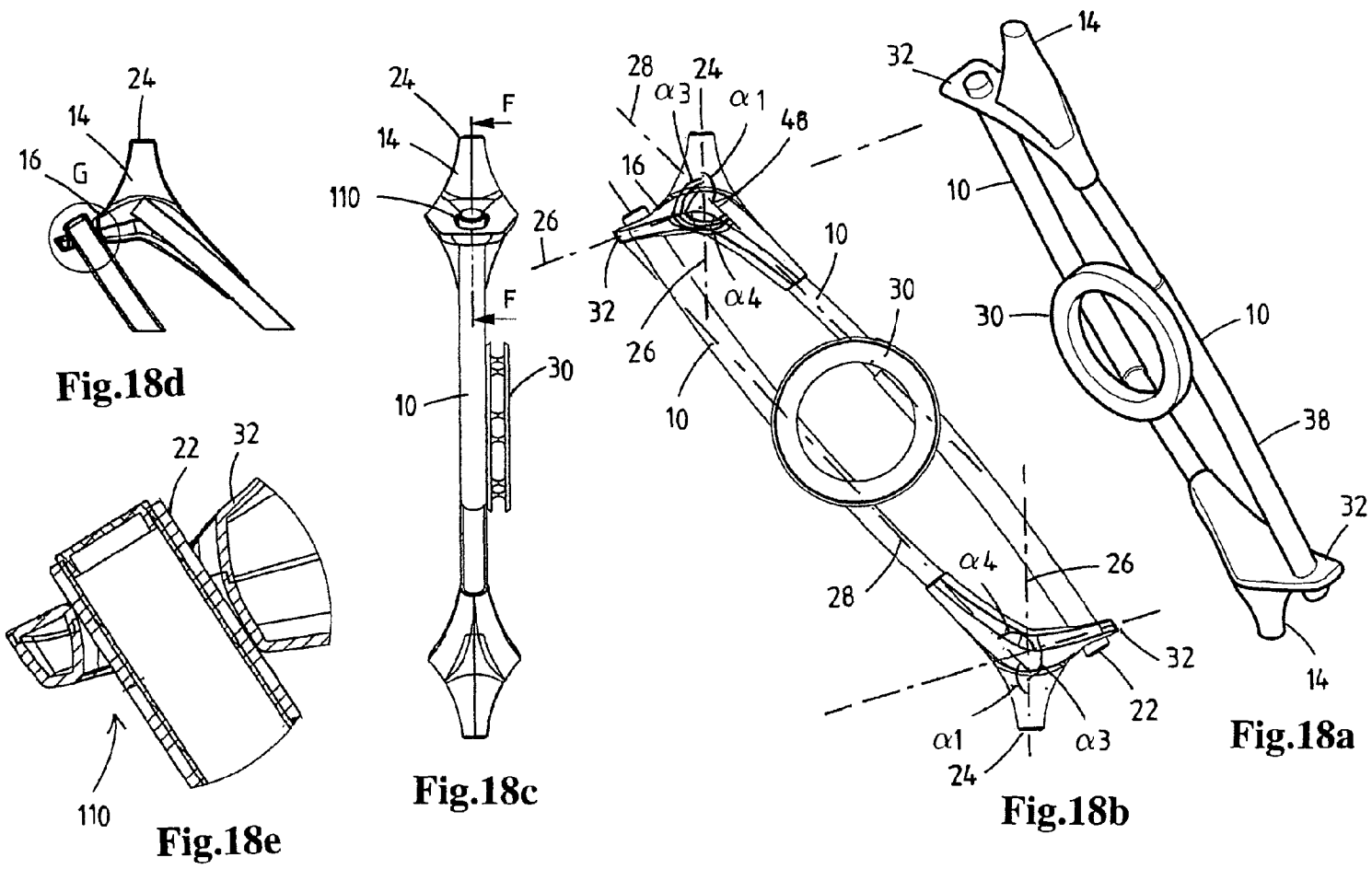
FIG. 18A shows a view of another embodiment of the invention.
FIG. 18B shows a side view of the embodiment of FIG. 18A.
FIG. 18C shows a side view from another direction of the embodiment of FIG. 18A.
FIG. 18D shows a cross-section in side view of a tip of the stick of the embodiment of FIG. 18A.
FIG. 18E shows a further enlarged cross-section in side view of a detail of the stick of the embodiment of FIG. 18A.

Turning to FIG. 18*b*, in side view, the ring support extension 32 defines a ring support axis 31, and the ring support axis 31 extends at an angle $\alpha 3$ of 90-120 degrees to the ring launching member axis, in particular 105-115 degrees.

In side view, the ring support axis 31 extends at an angle $\alpha 4$ of 90-150 degrees to the main section axis 28, in particular at an angle of 100-140 degrees.

Operation

Figures 16A, 16B, 16C:
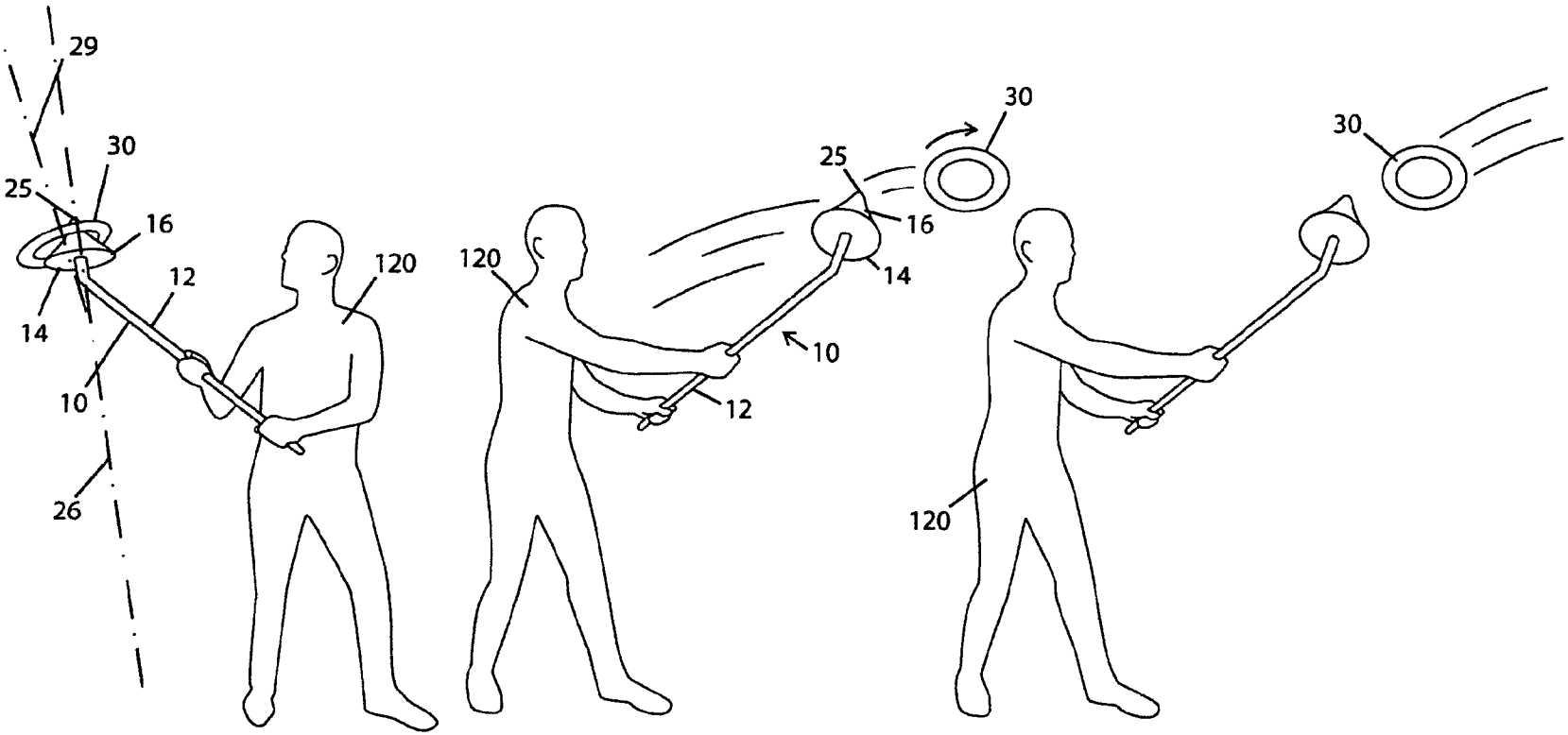
FIGS. 16A, 16B, 16C show views of the present invention in use

Turning to FIGS. 16A, 16B, 16C, the method of using the present invention is shown. A user 120 holds the stick 10 with both his hands. The stick 10 is oriented substantially horizontally, or at an angle to the horizontal of less than 60 degrees. The ring device 30 is positioned on the ring launching member 14 and typically abuts the stop 16. The ring device 30 is shown as a single airfoil, but it will be clear that a ring device comprising two airfoils is also possible.

The stick 10 is swung by the user 120, so that the distal end 25 makes a curved trajectory. The ring device 30 is launched from the stick 10. In flight, the ring device 30 rotates about the ring axis 29 and maintains a substantially stable flight position. The rotation allows a stable flight. The rotation is created by the friction force between the surface of the launching member 14 and the inner perimeter 79 of the ring device 30. At the moment of launch, the ring device 30 contacts the ring launching member 14 with the inner perimeter 79 and is positioned eccentric to the ring launching member. In other words, the ring device axis 29 is offset with respect to the launching member axis 26, and may also extend at an angle to the launching member axis 26. The eccentric position of the ring device 30 in combination with the swing of the stick by the user creates the rotation at take-off, i.e. the ring device is hurled from the ring launching member 14 in a rotary manner.

The ring device may also be launched from the stick by placing the tip of the ring launching device between the two airfoils of the ring device, creating a "clip" effect. The tip of the ring device is wedged between the two airfoils and may contact a strut. At the moment of launch, the ring device slides off the tip and starts rotating, allowing a stable flight.

To this end, the surface of the launching member may be quite rough and have roughened sections, see FIGS. 10A, 10B, 10C.

Turning to FIG. 16C another user 120 is positioned at a distance of between 5 and 50 meter from the first user and catches the incoming ring with the same stick 10, i.e. with the ring launching member 14. The ring comes to rest against the stop 16 and can be launched again quite quickly by the second user.

A typical combination (or kit—of parts) to be sold comprises two sticks 10 and one ring device 30, but other combinations are conceivable.

Turning to FIGS. 18A, 18B, 18C, 18D and 18E two sticks 10 are shown with a ring device 30. The sticks 10 have a ring support extension 32 which comprises a hole 110. The hole 110 can be used to fit two sticks together. The end 22 of one stick is inserted into the hole 110 of the other stick and vice versa. This facilitates transportation.

It will be recognized that the present invention has many features that are different from the ring tossing product according to U.S. Pat. No. 2,127,433. It will be obvious to a person skilled in the art that the details and the arrangement of the parts may be varied over considerable range without departing from the scope of the claims which define the invention.

The invention claimed is:

1. An apparatus comprising at least one stick (10) and a ring device (30) configured for throwing and catching the ring device with the stick, wherein:

the stick comprises:

a main section (12) configured to be held by the hands of a user, a ring launching member (14) provided at one end (25) of the stick and configured to launch and catch the ring device, and wherein the ring launching member is configured to extend through a central opening of the ring device (72), wherein a cross-sectional area of the ring launching member increases from a tip of the ring launching member to a base of the ring launching member, wherein the ring launching member defines an axis (26) which is oriented at an obtuse angle ($\alpha$1) to an axis (28) defined by the main section (12), wherein the ring launching member comprises an eccentric ring support extension (32) which is constructed to support the ring device in a launching position, wherein the eccentric ring support extension (32) provides an asymmetrical shape to the ring launching member and is located substantially on an opposite side of the axis (26) defined by the ring launching member as the obtuse angle ($\alpha$1) which is enclosed by the ring launching member axis (26) and the main section axis (28), and the central opening (72) is configured to fit on the ring launching member and be launched from the ring launching member.

2. The apparatus of claim 1, wherein the ring device (30) comprises two ring-shaped airfoils (70A, 70B) which are interconnected by one or more struts (22).

3. The apparatus of claim 2, wherein the two ring-shaped airfoils (70A, 70B) have similar profiles which are in an inverted orientation with respect to one another, and wherein the ring device is symmetrical about a plane (96) which extends at an equal distance to both ring-shaped airfoils (70A, 70B).

4. The apparatus of claim 2, wherein the two ring-shaped airfoils (70A, 70B) are positioned at a distance (74) from one another of between 1/10 and 1/3 of the diameter (76) of the central opening.

5. The apparatus of claim 1, wherein the eccentric ring support extension (32) defines a ring support axis (31), wherein the ring support axis extends at an angle $\alpha$3 of 90-120 degrees to the ring launching member axis (26).

6. The apparatus of claim 5, wherein the ring support member axis (31) extends at an angle $\alpha$4 of 90-150 degrees to the main section axis (28).

7. The apparatus of claim 1, wherein the eccentric ring support extension (32) defines a launching position for the ring device, and wherein in the launching position, an inner perimeter (79) of the ring device contacts the ring launching member on one side (170) of the ring launching member and wherein at the opposite side (171) a space (172) is provided between the inner perimeter (79) of the ring device and the ring launching member, wherein said space (172) is located on the side of the eccentric ring support extension.

8. The apparatus of claim 1, wherein at least a part of the main section (12) of the stick is curved, and wherein the angle ($\alpha$1) between the ring launching member axis (26) and a local orientation of the main section (12) decreases when travelling along the main section (12) in a direction away from the ring launching member (14).

9. The apparatus of claim 1, wherein the ring device comprises at least one ring-shaped airfoil (70A, 70B) having a separator lip (82) extending along an outer perimeter (94) of the airfoil, the separator lip being configured to force the airflow to become separate from the airfoil on at least one side of the airfoil.

10. The apparatus of claim 1, wherein, in the launching position, a centre of the ring device is offset with respect to the axis.

11. The apparatus of claim 1, further comprising a stop member (16) which has a diameter (50) which is greater than the diameter (76) of the central opening (72) of the ring device (30).

12. The apparatus of claim 1, wherein the main section (12) of the stick (10) is configured to be held by two hands, and wherein the stick has a length (20) of between 60 cm and 120 cm.

* * * * *